US005779574A

United States Patent [19]

Allman et al.

[11] Patent Number: 5,779,574

[45] Date of Patent: Jul. 14, 1998

[54] ELECTRONIC GAME FOOTBAG

[75] Inventors: Michael J. Allman; Mitchell Jeffrey Rood, both of Seattle, Wash.

[73] Assignee: Emjay Enterprise Corporation, Seattle, Wash.

[21] Appl. No.: 592,877

[22] Filed: Jan. 24, 1996

[51] Int. Cl.[6] ..... A63B 39/00; A63B 43/04

[52] U.S. Cl. ..... 473/570; 473/594

[58] Field of Search ..... 273/58 G, 58 F, 273/58 H, 58 E, 58 R, 415; 446/47, 247, 438; 473/569, 570, 571, 594

[56] References Cited

U.S. PATENT DOCUMENTS

| | | | |
|---|---|---|---|
| D. 281,521 | 11/1985 | Stalberger, Jr. et al. | D21/203 |
| D. 292,014 | 9/1987 | Stalberger, Jr. et al. | D21/205 |
| D. 299,845 | 2/1989 | Gray | D21/204 |
| D. 299,940 | 2/1989 | Fitzgerald et al. | D21/204 |
| 2,644,890 | 7/1953 | Hollihan | 473/594 |
| 2,849,819 | 9/1958 | Murphy et al. | 273/58 G |
| 3,304,651 | 2/1967 | Deyerl | 473/590 |
| 3,351,347 | 11/1967 | Smith et al. | 473/590 |
| 3,394,237 | 7/1968 | Baker | 473/590 |
| 3,531,892 | 10/1970 | Pearce | 473/590 |
| 3,580,575 | 5/1971 | Speeth | 273/58 G |
| 3,610,916 | 10/1971 | Meehan | 446/485 |
| 3,734,498 | 5/1973 | Seiersen | 473/594 |
| 3,786,246 | 1/1974 | Johnson et al. | 473/590 |
| 3,798,834 | 3/1974 | Samuel | 446/47 |
| 3,804,411 | 4/1974 | Hendry | 473/570 |
| 3,937,470 | 2/1976 | Stalberger, Jr. et al. | 473/594 |
| 4,002,893 | 1/1977 | Newcomb et al. | 473/570 |
| 4,011,611 | 3/1977 | Lederman | 473/594 |
| 4,015,111 | 3/1977 | Spector | 473/570 |
| 4,151,994 | 5/1979 | Stalberger, Jr. | 473/594 |
| 4,354,679 | 10/1982 | Steinmetz | 473/594 |
| 4,717,158 | 1/1988 | Pennisi | 473/570 |
| 4,737,143 | 4/1988 | Rumsey | 273/58 G |
| 4,801,141 | 1/1989 | Rumsey | 273/58 G |
| 4,943,066 | 7/1990 | Lathim et al. | 473/594 |
| 5,236,383 | 8/1993 | Connelly | 273/58 G |
| 5,566,953 | 10/1996 | Arriola et al. | 273/58 F |

*Primary Examiner*—Jessica Harrison
*Assistant Examiner*—James Schaaf
*Attorney, Agent, or Firm*—Christensen O'Connor Johnson & Kindness PLLC

[57] ABSTRACT

A game footbag includes an electronic light source circuit. The electronic light source circuit includes an energy source coupled to a light source and an inertial switch. In one embodiment, the energy source is a battery, and the light source includes a light emitting diode. The inertial switch is activated when the footbag is accelerated, such as, for example, when the footbag is kicked or struck. When activated, the inertial switch causes the light emitting diode to emit light. In another embodiment, a timer may be coupled to the inertial switch and the light emitting diode. When the inertial switch is activated, the timer is triggered, which causes the light emitting diode to emit light for a predetermined time period after the footbag is accelerated. In another embodiment, the electronic light source circuit includes a phototransistor that prevents the light source from emitting light when the footbag is exposed to light.

24 Claims, 3 Drawing Sheets

ELECTRONIC GAME FOOTBAG

FIELD OF THE INVENTION

The present invention relates to game balls and, more particularly, to game balls with electronic circuitry. The present invention is still more particularly related to game balls in the form of footbags with battery-powered electronically controlled illumination systems.

BACKGROUND OF THE INVENTION

Many games and sports employ a ball that users see and react to. The ball is suitably sized, shaped, weighted, and the like for the particular game or sport. One class of balls that is particularly pertinent to the present invention is the game footbag. Game footbags are designed to be repeatedly kicked into the air. The footbags typically are about three inches in diameter, soft and essentially non-bouncing. Many footbags are filled with small pellets or beads that can move within the footbag in an roughly fluid manner to help achieve the non-bouncing response when kicked. The fluid particulate also provides resistance to rolling.

Typically, game balls are used during daylight hours or under lights so that the users can see the ball. Of course, many users would prefer to have a ball that can also be used in darkness. To satisfy this demand, some manufacturers market self-illuminated balls. In particular, game footbags are available with chemical light sticks to facilitate use of the game footbag in darkness. For example, U.S. Pat. No. 4,963,117 issued to Gualdoni Oct. 16, 1990 and U.S. Pat. No. 4,717,117 issued to Pennisi Jan. 5, 1988 disclose game footbags with chemical light sticks. However, chemical light sticks typically provide a relatively low intensity of light. The chemical light sticks also interfere with the footbag's performance and can adversely affect the footbag's shape. Further, once activated, chemical light sticks generally have a relatively short life and cannot be turned off.

Other game balls use a battery-powered light source. For example, U.S. Pat. No. 4,002,893 issued to Newcomb et. al. Jan. 11, 1977 discloses a ball with an internal battery-powered light source. This light source has a switch and is housed in a tube that can be removed from the ball. U.S. Pat. No. 4,002,893 discloses that the principle reason for removal of the tube from the ball is to enable the switch to be actuated to turn the light on or off according to the user's wishes. Thus, the user must remove the light source and manually operate a switch to turn the light source on and off. U.S. Pat. No. 3,610,916 issued to Meehan Oct. 5, 1971 discloses a ball made of high-impact plastic with battery-powered light bulbs and an inertia switch. Apparently, the high impact plastic is required because the light bulbs, inertia switch and battery are fixedly attached to interior surfaces of the ball. Such a rigid structure is not suitable for use in a game footbag. Further, the conventional light bulbs (and most other types of filament light sources) are also not suitable for use in a game footbag because the filaments are susceptible to breakage from the repeated kicks experienced by the game footbag while it is being used. The Meehan patent also discloses a time delay circuit consisting of a conventional RC time delay network controlling the current conducted through the light bulbs. Because of the RC network, the current conducted by the light bulbs is non-constant, and thus the light bulbs emit light of non-constant intensity. In addition, the amount of charge stored by the RC network is dependent on the duration the inertial switch is closed. Consequently, the duration of the time delay and the intensity of the light is random rather than predetermined. In addition, depending on the power dissipation of the circuitry, the RC network may be impractical for implementing a time delay of more than a few seconds because the RC network cannot be store sufficient energy during the time the inertia switch is typically closed. The time delay appears to be intended to merely prevent flickering while the ball is being moved.

SUMMARY OF THE INVENTION

In accordance with the present invention, an electronic self-illuminated game ball is provided. One embodiment of the game ball includes a skin enclosing a space, with a plurality of beads and an electronic light source circuit disposed within the space enclosed by the skin. The electronic light source circuit includes a light source, an energy source, and an inertial switch. The energy source provides energy to operate the light source. The inertial switch causes the light source to emit light when the game ball is accelerated. As a result, the game ball emits light when it is, for example, kicked, struck or thrown, thereby facilitating its use in the dark. The inertial switch provides the further advantage of allowing the user to activate the light source in the game ball simply by accelerating the game ball above a predetermined threshold, rather than requiring the user to insert a chemical light stick into, disassemble the game ball to access a switch or remove a tube from the game ball (and manually operate a switch), as required in some conventional game balls.

In another embodiment, the game ball includes a timer that is triggered by the inertial switch and, in response, causes the light source to emit light for a predetermined amount of time after the game ball is accelerated. Thus, the game ball will continue to emit light while in use. After the predetermined time period has elapsed with no acceleration of the game ball, the timer causes the light source to abruptly stop emitting light. As a result, the timer allows the user to turn off the electronic light source circuit simply by leaving the game ball stationary. Thus, this embodiment avoids the disadvantages of some conventional self-illuminated game balls that remain on until the energy source is dissipated (e.g., chemical light sticks) or require the user to disassemble the game ball or remove the light source from the game ball and manually operate a switch to turn off the light source.

In still another embodiment, the game ball includes a light detector that prevents the light source from emitting light when the game ball is exposed to light. Consequently, the light detector reduces the amount of energy dissipated by the game ball when the game ball is used in a lighted area and self-illumination is not needed.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
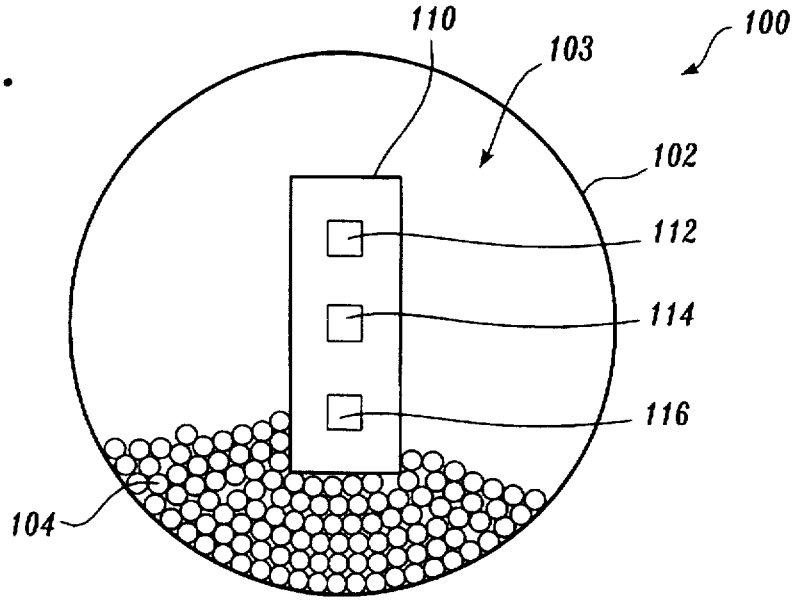
FIG. 1 is a simplified block diagram of one embodiment of a game ball according to the present invention.

FIG. 1 is a simplified block diagram of one embodiment of a game ball 100 according to the present invention. The ball 100 includes a skin 102 that defines and encloses an interior space 103. Although shown as a circle in cross-section and defining a roughly spherical interior space, the skin may define an interior space of any shape suitable for the desired game or sport. For example, the skin may define an interior space in the shape of an elongated spheroid (i.e., football shaped) or a faceted sphere.

The skin 102 is preferably made of a light transmissible, pliable material molded into hemispheres. Two of the hemispheres are then attached together to form a sphere. The hemispheres can be made of any suitable pliable, light-transmissible material, such as, for example, elastomers having a durameter reading of about 30, available from Fleck Co., Auburn, Wash. The skin 102 may have one or more openings to permit air to move into or out of the space 103 when the ball 100 is deformed. In other embodiments, the skin 102 can be made of light-transmissible sheets of pliable material, which are suitably cut into pieces and sewn together into a roughly spherical shape.

The space 103 is filled with a large number of pellets or beads 104 forming a fluid particulate filler. Preferably, the beads 104 are also made of light transmissible material and substantially entirely fill the space 103. The beads 104 can be made of any suitable material, such as, for example, polystyrene also available from Fleck Co., Auburn, Wash. The skin 102 holds the beads 104 in an essentially fluid manner within the space 103. Thus, for example, when a user kicks or strikes the ball 100, the beads 104 move in a fluid manner and allow the ball 100 to deform, thereby reducing the ball's coefficient of elasticity and, therefore, the tendency of the ball 100 to bounce from the impact of the kick. In this embodiment, the skin 102 and the beads 104 are sized and weighted in accord with conventional footbags. Of course, other embodiments of the ball may use other skin and filler materials to achieve the desired shape, texture, weight and resiliency.

The ball 100 also includes an electronic light source circuit 110 disposed within the space 103. The electronic light source circuit 110 includes a light source 112, an energy source 114, and an inertial switch 116. The light source 112 uses energy received from the energy source 114 to emit light. The inertial switch 116 is activated when it is accelerated. When activated, the inertial switch 116 causes the light source 112 to emit light. Thus, for example, when a user kicks the ball 100, the inertial switch 116 is activated, which causes the light source 112 to emit light. The light source 112 emits light of a predetermined intensity. For example, the light source 112 can emit a substantially constant light rather than the fading light emitted by some conventional self-illuminated game balls.

Figure 2:
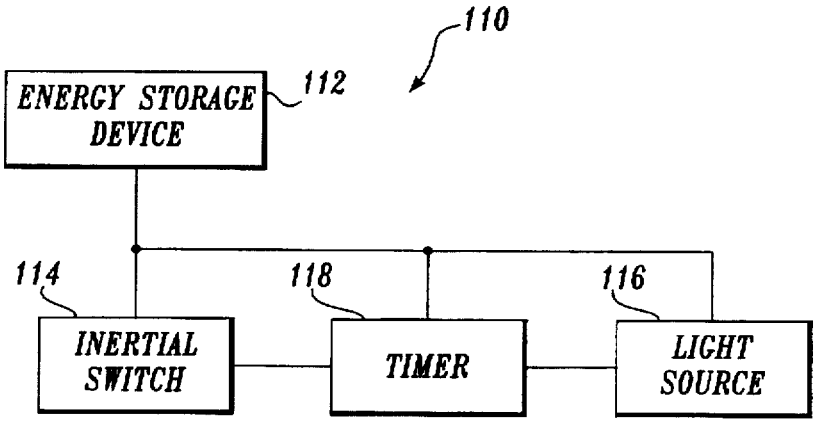
FIG. 2 is a block diagram of one embodiment of an electronic light source circuit for use in a game ball according to the present invention.

FIG. 2 is a block diagram of one embodiment of the electronic light source circuit 110 according to the present invention. In this embodiment, the electronic light source circuit 110 includes a timer 118 as well as the previously described energy source 112, the inertial switch 114 and the light source 116. The energy source provides energy to the inertial switch 114, timer 118 and the light source 116. The inertial switch 114 is connected to the timer 118. As described above, the inertial switch is activated when it is accelerated. When activated, it triggers the timer 118, which is connected to the light source 116. When triggered, the timer 118 causes the light source 116 to emit light for a predetermined period of time. At the end of this period of time, the timer 118 causes the light source 116 to turn off. If the timer is triggered during the predetermined time period, the timer restarts. Thus, for example, a game footbag including electronic light source circuit 110 with a suitable predetermined time period (e.g., thirty seconds) would emit light continuously while being maintained in the air with kicks in the usual manner. Then about thirty seconds after use is ended, the footbag would turn off, thereby conserving the life of the energy source 112. If the footbag is dropped during use, the thirty second time period is sufficient to allow the users to locate the footbag in the dark and resume use. In contrast, some conventional self-illuminated game balls have a random time delay. Further, the random time delay provided by these conventional game balls may not be sufficiently long to allow the users to find the ball in the dark if the ball is lost during play.

Figure 3:
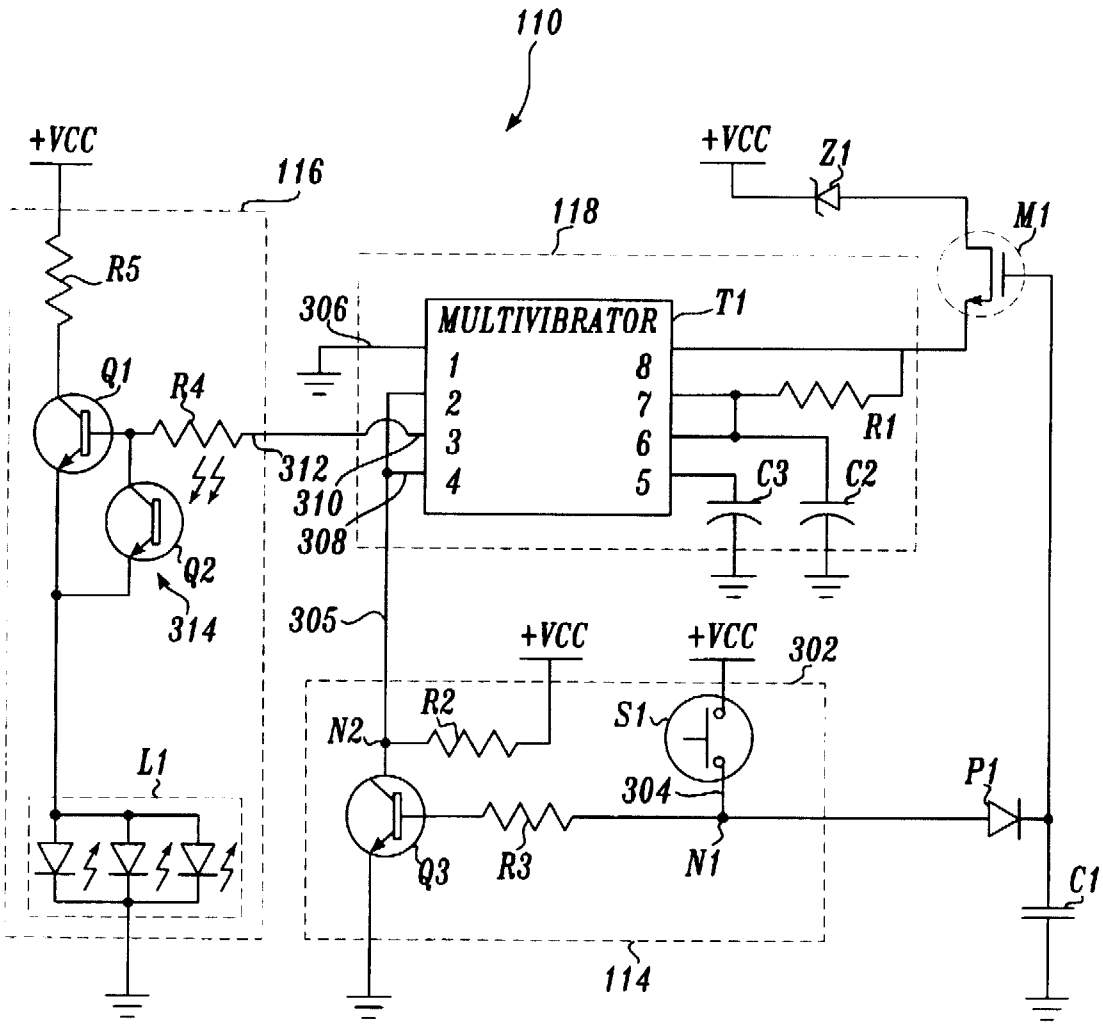
FIG. 3 is a schematic diagram of one embodiment of an electronic light source circuit for use in a game ball according to the present invention.

FIG. 3 is a schematic diagram of one embodiment of the electronic light source circuit 110 according to the present invention. The energy source 112 is connected to the VCC line and the ground line to supply energy to the rest of the circuitry of the electronic light source circuit 110. In this embodiment, the energy source 112 is a battery supplying a voltage of approximately 4.4 volts between the VCC and ground lines. The energy source 112 can be any suitable battery such as, for example, silver oxide button cells model S76 available from EVEREADY.

The inertial switch 114 includes an acceleration detector S1 having a lead 302 connected to the VCC line and another lead 304 connected to a node N1. In this embodiment, the acceleration detector S1 is normally open switch and is closed when accelerated (i.e., the inertial switch 114 is activated). Consequently, the inertial switch is activated when the acceleration detector S1 closes, which causes the voltage at the node N1 to be substantially equal to 4.4 volts.

A resistor R3 connects the node N1 to the base of a npn transistor Q3. The transistor Q3 has its emitter connected to the ground line and its collector connected to a node N2, which is connected to the output lead 305 of the inertial switch 114. A resistor R2 connects the node N2 to the VCC line. Thus, the acceleration detector S1 is normally not closed, which causes the transistor Q3 to be off. The resistor R2 pulls up the voltage at the node N2 to be approximately equal to 4.4 volts, causing the inertial switch to output a logic high voltage level. However, when the acceleration detector S1 is closed, the voltage at the base of the transistor Q3 rises, turning on the transistor Q3. Consequently, the transistor Q3 conducts a current through the resistor R2 causing the voltage at the node N2 to drop to a logic low level. Accordingly, the inertial switch 114 outputs a logic low voltage level when the inertial switch is activated and a logic high voltage level when the inertial switch is not activated. Of course, to be compatible with other timers that are triggered with a logic high voltage level, the inertial switch can easily be modified to output a logic high voltage level when the inertial switch 114 is activated and a logic low voltage level when the inertial switch is not activated. For example, the acceleration detector can be a normally-closed device, or an inverter may be connected to the node N1.

The timer 118 includes a multivibrator T1, which in this embodiment is a conventional low power 555 type timer.

The multivibrator T1 can be any suitable multivibrator such as, for example, a model TLC555 device available from Texas Instruments. The multivibrator T1 has its trigger input leads 306 and 308 (pins 2 and 4, respectively) connected to the output lead 305 of the inertial switch 114. The multivibrator T1 is configured in the conventional manner for monostable operation and is triggered when it receives a low-to-high voltage transition on its trigger input leads 306 and 308. Thus, when activated, the inertial switch 114 is momentarily closed. Consequently, the inertial switch provides a low-to-high voltage transition on the trigger input leads 306 and 308, triggering the multivibrator T1. A resistor R1 and capacitors C2 and C3 are connected to the multivibrator T1 to control the duration of a pulse outputted by the multivibrator T1 at its output lead 310 when it is triggered. In this embodiment, the values of the resistor R1 and the capacitors C2 and C3 are chosen to cause the timer 118 to output a pulse having a duration of approximately thirty seconds when the timer 118 is triggered. Although a timer using a multivibrator is described above, any type of suitable timer may be used. For example, a conventional a counter and oscillator circuit may be used to instead of the timer 118.

The output lead 310 of the timer 118 is connected to the input lead 312 of the light source 116. The light source 116 includes a resistor R4 connecting the input lead 312 to the base of a npn transistor Q1. The transistor Q1 has its collector coupled to the VCC line through a resistor R5 and its emitter connected to the input lead of a light emitting diode (LED) circuit L1. When the electronic light source circuit 110 is not exposed to light, a logic one voltage level at input lead 312 will cause the transistor Q1 to turn on and provide a current to the LED circuit L1. Thus, the transistor Q1 is turned on for approximately thirty seconds after the timer 118 is triggered and the electronic light source circuit 110 is not exposed to light. However, if the electronic light source circuit 110 is exposed to light, a photodetector 314 connected to the base and emitter of the transistor Q1 causes the transistor Q1 to turn off. In this embodiment, the photodetector 314 is a npn phototransistor Q2 having its collector and emitter respectively connected to the base and emitter of the transistor Q1. As a result, when the phototransistor Q2 is exposed to a sufficient intensity of light, it effectively shorts the base-emitter junction of the transistor Q1. The value of the resistor R4 is suitably chosen so that the photodetector 314 is suitably sensitive to light. Consequently, the transistor Q1 is turned off whenever the electronic light source circuit 110 is exposed to light. Accordingly, power dissipation is greatly reduced during use in lighted conditions, thereby conserving the life of the energy source.

The LED circuit L1 has its output lead connected to the ground line. As described above, when the transistor Q1 is on, it provides a current to the LED circuit L1. The LED circuit L1 conducts this current to the ground line, which causes the LED circuit L1 to emit light. Although any suitable LED circuit can be used, in this embodiment, the LED circuit L1 is implemented with three discrete high brightness LED devices, such as model AND130CR available from AND Electronics, Sunnyvale, Calif.

In embodiments without a timer, the node N1 could be coupled to the base of the transistor Q1 through a resistor. Consequently, when the inertial switch 114 is activated, the voltage at the node N1 rises, turning on the transistor Q1. The transistor Q1 remains on for roughly the time the inertial switch 114 is activated. As a result, the LED circuit L1 would flash on while the electronic light source circuit 110 is accelerated, providing low light levels. A small capacitor can be connected between the base of the transistor Q1 and the ground line to increase the duration of the flash. In embodiments without a photodetector, the flash may have a greater intensity and/or duration. In other embodiments, this circuit can be combined with a second LED circuit (preferably of a different color) controlled by a timer as described above. This combination can be used in a game footbag that not only provides a constant light while being used, but also flashes every time it is kicked.

In this embodiment, the electronic light source circuit 110 is coupled to the VCC line through a n-channel enhancement field effect transistor (FET) M1. In this embodiment, the FET M1 is a metal-oxide semiconductor field effect transistor (MOSFET) type of device. The term MOSFET is used herein to also refer to silicon gate technologies. The FET M1 has its drain connected to the VCC line, its source connected to the VCC input lead (pin 8) of the multivibrator T1, and its gate coupled to the ground line through a capacitor C1. The gate of the FET M1 is also coupled to the node N1 of the inertial switch 114 through a diode P1. The diode P1 has its anode connected to the node N1 and its cathode connected to the gate of the FET M1 and, thus, prevents charge from flowing the capacitor C1 through the base-emitter junction of the transistor Q3.

In another embodiment, a zener diode Z1 with a breakdown voltage of approximately 3.2 volts can be connected between the drain of the FET M1 and the VCC line in the electronic light source circuit 110 depicted in FIG. 3. The zener diode Z1 maintains the drain voltage of FET M1 at approximately 3.2 volts. As a result, a voltage across the capacitor C1 of greater than approximately 3.9 volts will turn on FET M1. When the capacitor C1 is charged to about 4.4 , the voltage across the capacitor C1 will remain above 3.9 volts for approximately 10 minutes.

Referring back to the electronic light source circuit 110 depicted in FIG. 3, when the inertial switch is activated (i.e., acceleration detector S1 is closed), the capacitor C1 is substantially instantaneously charged through the diode P1, turning on the FET M1. Because the drain of the FET M1 is connected to the VCC line, when the FET M1 is on, the multivibrator T1 receives a voltage approximately equal to 4.4 volts at its VCC input pin (pin 8). The capacitor C1 remains sufficiently charged to keep the FET M1 on for over thirty seconds after the inertial switch 114 is activated.

When the FET M1 is off, the VCC input pin of the multivibrator T1 is electrically isolated from the VCC line, thereby turning off the multivibrator T1 and reducing power dissipation to conserve the life of the energy source 112 when the ball is not in use. Thus, with three type 76 silver oxide batteries implementing the energy source 112 and three LEDs implementing the LED circuit L1, the ball provides approximately 130 hours of light.

Figure 4:
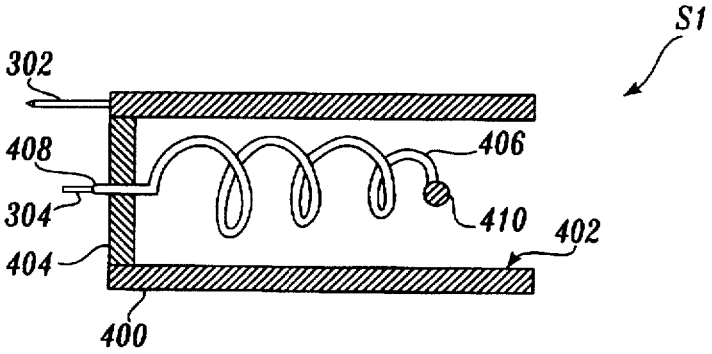
FIG. 4 is a vertical sectional representation of one embodiment of an acceleration detector according to the present invention.

FIG. 4 is a vertical sectional representation of one embodiment of the acceleration detector S1 according to the present invention. The acceleration detector S1 includes a housing 400. In this embodiment, the housing 400 is implemented with a metal cylindrical tube. Thus, the housing 400 has a conductive inner surface 402. The inner surface 402 of the housing 400 is electrically connected to lead 302, which, as shown in FIG. 3, is connected to the VCC line.

The acceleration detector S1 also includes a non-conductive plug 404 fixedly attached to and approximately flush with an end 405 of the housing 400. The plug 404 can be attached to the housing 400 in any suitable manner such as, for example, using an adhesive and/or press-fitting (i.e., tightly fitting the plug 404 into the end 405 and using the compressional and frictional forces between the housing 400 and the fitted plug 404 to hold the plug 404 in the housing 400) to attach the plug 404 to the housing 400. A flexible conductor 406 is disposed within the housing 400 and attached to the plug 404. In this embodiment, the flexible conductor 406 is a metal spring having an end 408 fitted to a hole in the plug 404. The end 408 of the flexible conductor 406 extends through the plug 404 and beyond the end 405 of the housing 400. The end 408 of the flexible conductor 406 is electrically connected to the lead 304, which, as shown in FIG. 3, is connected to the node N1 of the inertial switch 114.

A conductive mass 410 (e.g., a set screw) is fixedly attached to the other end of the flexible conductor 406, but is supported by the flexible conductor 406 so that the conductive mass 410 does not make electrical contact with the inner surface 402 of housing 400 when the acceleration detector S1 is not accelerated. When the acceleration detector undergoes most accelerations above a predetermined threshold, the flexible conductor 406 bends or flexes so that the conductive mass 410 and/or the flexible conductor 406 makes momentary electrical contact with the inner surface 402 of the housing 400. Thus, lead 302 is electrically connected to lead 304 (see also FIG. 3). Acceleration solely along the longitudinal axis of the housing 400 may not cause the conductive mass 410 and/or the flexible conductor 406 to make electrical contact with the inner surface 402 of the housing 400, but the probability of such an acceleration in this particular orientation is negligible. The mass of the conductive mass 410 and the length of the flexible conductor 406 are designed so that, in conjunction with the mechanical characteristics of the flexible conductor 406, the threshold acceleration of the acceleration detector S1 is set to a suitable predetermined value.

Figure 5:
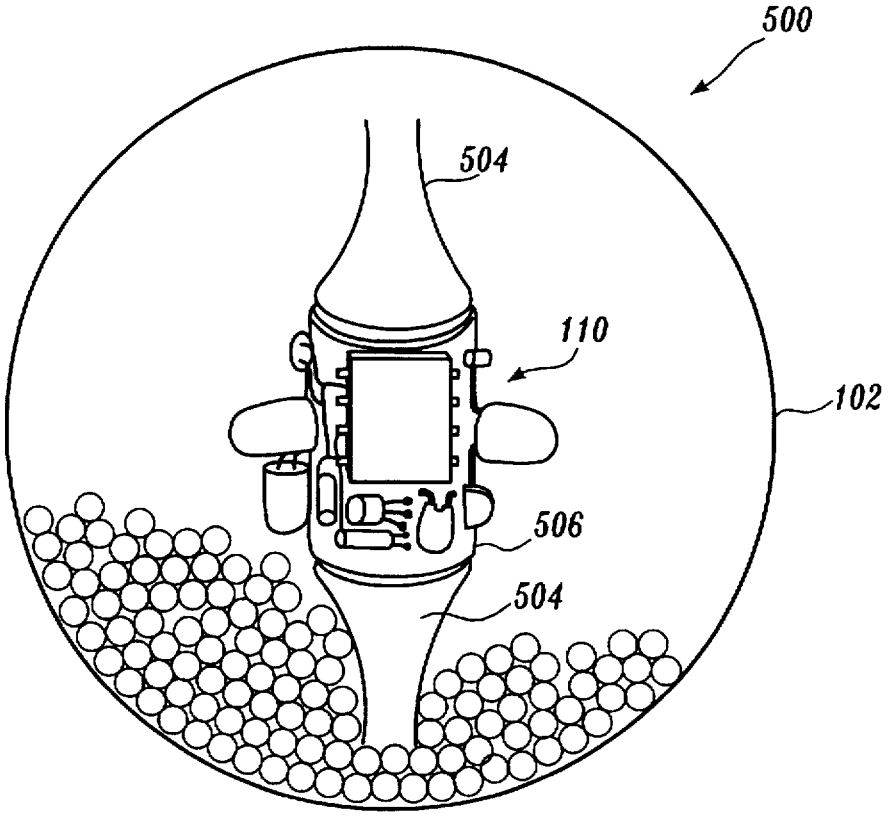
FIG. 5 is a vertical sectional view of one embodiment of a game footbag according to the present invention.

FIG. 5 is a vertical sectional view of one embodiment of a game footbag 500 according to the present invention. The footbag 500 includes the electronic light source circuit 110, which incorporates a capsule 502 containing batteries implementing the energy source 112 (FIG. 2). A pair of positioning structures 504 are attached to the capsule 502 of the electronic light source circuit 110 to help maintain the electronic light source circuit 110 at or near the center of the footbag 500. Structures 504 are preferably made of the same or similar material as the skin 102 so that they do not interfere with use of the footbag yet prevent the electronic light source circuit from drifting close to the skin 102 during use.

As shown in FIG. 5, this embodiment of the electronic light source circuit is roughly cylindrical. The inertial switch 114, timer 118 and light source 116 and other components shown in FIG. 3 are mounted on a flexible interconnect structure 506, which is then wrapped around the capsule 502. The flexible interconnect structure 506 can be any suitable non-rigid interconnect structure providing conductors to electrically interconnect the components such as, for example, a flexible circuit board available from Smart Flex Systems, Tustin, Calif. or Multi-Fineline Electronics Inc., Anaheim, Calif. The flexible circuit board resembles a ribbon cable with custom routed conductors. The components shown in FIG. 3 are then mounted on the flexible circuit board using conventional surface mount technology. The electronic light source circuit can then be encased in a protective translucent shell. This shell can be used to secure the flexible interconnect structure 506 and the structure 504 to the capsule 502. Although a flexible interconnect structure is described above, it is understood that any suitable type of wiring and mounting technology can be used.

It is to be understood that the embodiments of the invention described above are illustrative of the principles of the invention and are not intended to limit the invention to those embodiments. For example, in other embodiments, the skin may be sewn together from cloth such as synthetic suede rather than molded from elastomers. In other embodiments, the energy source may be removable to be replaced or recharged. In still other embodiments, different combinations of electronic light source circuits, with or without timers, may be used to provide flashes or constant light of variable duration, different colored light, flashes of different colored light in varying sequences, or possible combinations. Of course, different types of light sources, light detectors, timers, energy sources and other electronic components can be used instead of the specific components used in the embodiments described. Accordingly, while the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A game footbag comprising:

a light transmissible pliable skin enclosing a space;

a light transmissible filler disposed within said space, said skin retaining said filler in an approximately fluid manner; and an electronic light source circuit disposed within said space, said electronic light source circuit comprising a light source, an energy source, and an inertial switch, said energy source being coupled to said light source and said inertial switch, wherein activation of said inertial switch causes said light source to emit light of a predetermined intensity.

2. The footbag of claim 1 wherein said light source further comprises a light detector, wherein said light detector prevents said light source from emitting light when said footbag is exposed to light.

3. The footbag of claim 2 wherein said inertial switch comprises:

a housing with a conductive inner surface; and a flexible conductor mounted within said housing and electrically isolated from said conductive inner surface of said housing, wherein said flexible conductor makes electrical contact with said conductive inner surface when said housing undergoes acceleration and does not make electrical contact with said conductive inner surface when said housing undergoes no acceleration.

4. The footbag of claim 2 wherein said electronic light source circuit further comprises a timer coupled to said light source and said inertial switch, wherein said timer is capable of causing said light source to emit light for a predetermined time period when said inertial switch is activated.

5. The footbag of claim 4 wherein said timer comprises a multivibrator.

6. The footbag of claim 5 wherein said light source comprises a light emitting diode.

7. The footbag of claim 6 wherein said timer causes said light emitting diode to emit light of constant intensity for a predetermined time period beginning immediately after said timer is triggered.

8. The footbag of claim 6 wherein said light source further comprises a first transistor coupled between said light emitting diode and said timer, wherein said first transistor is capable of providing a current to said light emitting diode.

9. The footbag of claim 8 wherein said light detector comprises a phototransistor coupled to said first transistor.

10. The footbag of claim 4 further comprising a transistor coupling said energy source to said timer, said timer receiving energy to operate from said energy source through said transistor when said second transistor is conductive and not receiving energy to operate when said transistor is non-conductive.

11. The footbag of claim 4 wherein said electronic light source circuit further comprises a flexible interconnect structure, wherein said flexible interconnect structure includes conductors electrically connected to said inertial switch, said energy source, said timer, said light source and said light detector, said flexible interconnect structure being wrapped around said energy source.

12. A method of operating a light source within a game ball, the game ball having a light transmissible skin and a light transmissible filler, the filler filling a space enclosed by the skin in an approximately fluid manner, said method comprising:

supporting a light source within the space with the filler, detecting when said game ball is accelerated;

activating said light source to provide a predetermined intensity of light when said game ball undergoes acceleration; and deactivating said light source after said game ball undergoes no acceleration.

13. The method of claim 12 wherein said light source is deactivated after a predetermined period of time elapses, the predetermined time period beginning when acceleration of said game ball is terminated.

14. The method of claim 13 further comprising detecting when said game ball is exposed to light and deactivating said light source when said game ball is exposed to light.

15. A game ball comprising:

a light transmissible pliable skin enclosing a space;

a light transmissible particulate filler within said space;

means, disposed within said space, for detecting when said game ball is accelerated;

means, disposed within said space, for activating a light source when said game ball undergoes acceleration; and means, disposed within said space, for deactivating said light after said game ball undergoes substantially no acceleration.

16. The game ball of claim 15 wherein said means for deactivating deactivates said light source after a predetermined period of time elapses, the predetermined period of time beginning at the moment when acceleration of said game ball is terminated.

17. The game ball of claim 16 further comprising means for detecting when said game ball is exposed to light and deactivating said light source when said game ball is exposed to light.

18. A game ball comprising:

a light transmissible pliable skin enclosing a space;

a light transmissible particulate filler disposed within said space; and an electronic light source circuit disposed within said space and amongst said particulate filler, said electronic light source circuit comprising a light source, an energy source, a timer and an inertial switch, said energy source being coupled to said light source and said inertial switch, wherein activation of said inertial switch triggers said timer, said timer causing said light source to emit light of predetermined intensity for a predetermined time period after said inertial switch is activated.

19. A game ball comprising:

a light transmissible pliable skin enclosing a space;

a light transmissible particulate filler disposed within said space; and a game ball comprising:

an electronic light source circuit disposed within said space and amongst said particulate filler, said electronic light source circuit comprising a light source, an energy source, a timer and an inertial switch, said energy source being coupled to said light source and said inertial switch, wherein activation of said inertial switch triggers said timer, said timer causing said light source to emit light of predetermined intensity for a predetermined time period after said inertial switch is activated, wherein said electronic light source circuit further comprises a light detector coupled to said light source, wherein said light detector prevents said light source from emitting light when said game ball is exposed to light.

20. The footbag of claim 18 wherein said filler comprises a plurality of light transmissible beads, said filler retained within said space by said skin in an essentially fluid manner.

21. The footbag of claim 1 further comprising a timer coupled to said light source, said energy source and said inertial switch, wherein said activation of said inertial switch also initializes said timer, said timer configured to cause said light source to receive a constant level of energy for a time period defined by said initialized timer.

22. The footbag of claim 21 wherein said light source comprises:

a light emitting diode; and a transistor having a first lead, a second lead, and a third lead, said first lead coupled to said light emitting diode, said second lead of said transistor coupled to said timer and said third lead of said transistor coupled to said energy source, wherein said timer is configured to cause said transistor to conduct a substantially constant current for said time period, whereby said light emitting diode emits a constant intensity of light during said time period.

23. The footbag of claim 21 wherein said timer comprises a resistor-capacitor network.

24. The footbag of claim 22 wherein said transistor is a bipolar transistor.

* * * * *